US010189668B2

(12) United States Patent
Fukushima et al.

(10) Patent No.: US 10,189,668 B2
(45) Date of Patent: Jan. 29, 2019

(54) SHEET CUTTING MACHINE

(71) Applicant: Horizon International Inc., Shiga (JP)

(72) Inventors: Kazuyuki Fukushima, Shiga (JP); Tatsuaki Ida, Shiga (JP)

(73) Assignee: Horizon International Inc., Shiga (JP)

( * ) Notice: Subject to any disclaimer, the term of this patent is extended or adjusted under 35 U.S.C. 154(b) by 0 days.

(21) Appl. No.: 15/565,685

(22) PCT Filed: Jul. 23, 2015

(86) PCT No.: PCT/JP2015/070914
§ 371 (c)(1),
(2) Date: Oct. 11, 2017

(87) PCT Pub. No.: WO2017/013779
PCT Pub. Date: Jan. 26, 2017

(65) Prior Publication Data

US 2018/0118499 A1 May 3, 2018

(51) Int. Cl.
*B65H 35/00* (2006.01)
*B41J 11/70* (2006.01)
(Continued)

(52) U.S. Cl.
CPC ..... *B65H 35/0093* (2013.01); *B65H 29/20* (2013.01); *B65H 29/60* (2013.01);
(Continued)

(58) Field of Classification Search
CPC .... B65H 35/0093; B65H 29/20; B65H 29/60; B65H 35/06; B65H 2301/51512; B65H 2301/515326; B65H 2801/03; B41J 11/70
See application file for complete search history.

(56) References Cited

U.S. PATENT DOCUMENTS

2011/0211900 A1* 9/2011 Ueda ..... B26D 1/095 400/621
2013/0154176 A1* 6/2013 Oshima ..... B65H 39/00 270/37

(Continued)

FOREIGN PATENT DOCUMENTS

JP 2001-232700 8/2001
JP 2003-326783 11/2003

(Continued)

OTHER PUBLICATIONS

International search report dated Sep. 1, 2015 mailed in corresponding international application No. PCT/JP2015/070914.

*Primary Examiner* — Omar Flores Sanchez
(74) *Attorney, Agent, or Firm* — Kirschstein, Israel, Schiffmiller & Pieroni, P.C.

(57) ABSTRACT

When a length in a conveying direction of a margin to be cut off is shorter than a predetermined distance between a cutting part and a second conveying part, a sheet cutting machine feeds a first sheet to the cutting part using a first conveying part while keeping the second conveying part positioned at a conveying path. When the length is equal to or longer than the predetermined distance, the machine feeds the first sheet to the cutting part using the first conveying part after upwardly retracting the second conveying part from the conveying path using a retracting mechanism.

5 Claims, 9 Drawing Sheets

(51) Int. Cl.
*B65H 35/06* (2006.01)
*B65H 29/20* (2006.01)
*B65H 29/60* (2006.01)

(52) U.S. Cl.
CPC ... *B65H 35/06* (2013.01); *B65H 2301/51512* (2013.01); *B65H 2301/515326* (2013.01); *B65H 2801/03* (2013.01)

(56) References Cited

U.S. PATENT DOCUMENTS

| | | | | |
|---|---|---|---|---|
| 2017/0279993 | A1* | 9/2017 | Kakuta | B65H 5/062 |
| 2018/0093845 | A1* | 4/2018 | Hirata | B65H 29/58 |

FOREIGN PATENT DOCUMENTS

| | | |
|---|---|---|
| JP | 2011-230222 | 11/2011 |
| JP | 2013-082522 | 5/2013 |

* cited by examiner

SHEET CUTTING MACHINE

TECHNICAL FIELD

The present invention relates to a sheet cutting machine for conveying a sheet and cutting the sheet in a direction perpendicular to a conveying direction.

BACKGROUND ART

In the prior art, a sheet cutting machine conveys sheets one by one along a conveying path, cuts each of the sheets into margins and desired size of products, removes the margins from the conveying path, and thereby stacks only the products on a tray. The sheet cutting machine, for example, comprises a slitting unit arranged to cut the sheet in a conveying direction using slitters, and a cutting unit arranged downstream of the slitting unit to cut the sheet in a direction perpendicular to the conveying direction using a pair of cutting blades.

The cutting unit includes a pair of upstream conveying rollers to convey the sheet along the conveying path, a pair of cutting blades arranged downstream of the upstream conveying rollers to cut the sheet into the products and the margins, and a pair of downstream conveying rollers arranged downstream of the cutting blades to convey along the conveying path the products cut off from the sheet.

In order to separate a margin of the sheet front end from the sheet and remove the margin from the conveying path, the cutting unit first conveys the sheet using the upstream conveying rollers in such a manner that the sheet is travelled from a gap between the pair of the cutting blades by a predetermined length. The cutting unit then cuts the sheet in the direction perpendicular to the conveying direction using the pair of the cutting blades. Thereby, the margin of the sheet front end is separated from the sheet and removed from the conveying path by falling down from a gap between the cutting blades and the downstream conveying rollers.

However, when the length in the conveying direction of the margin is longer than a distance between the cutting blades and the downstream conveying rollers, it is impossible to remove the margin from the conveying path in one cutting operation described above. This is because the sheet is received by the downstream conveying rollers when being conveyed by the upstream conveying rollers, and as a result, the margin which has been cut off from the sheet is conveyed along the conveying path by the downstream conveying rollers.

Each of Patent Literatures 1 and 2 discloses a sheet cutting machine which can solve such a problem. In the sheet cutting machines of Patent Literatures 1 and 2, when the length in the conveying direction of the margin is equal to or longer than a distance between the cutting blades and the downstream conveying rollers, the margin is cuts off in several cutting operations instead of one cutting operation described above.

Conveyance of the sheet by the upstream conveying rollers needs to be temporarily paused while the sheet is cut. In other words, in order to separate the margin from the sheet in the several cutting operations described above, conveyance of the sheet has to be paused during every cutting operation. This reduces the efficiency of the sheet cutting machine.

CITATION LIST

Patent Literatures

[Patent Literature 1] Japanese Patent Laid-Open No. 2013-82522

[Patent Literature 2] Japanese Patent Laid-Open No. 2001-232700

SUMMARY OF THE INVENTION

Problem to be Solved by the Invention

An object of the present invention is to provide a sheet cutting machine capable of separating a margin from the sheet in one cutting operation and reliably removing the margin from the conveying path even when a length in a conveying direction of the margin is long.

Means for Solving the Problem

According to the present invention, there is provided a sheet cutting machine for cutting a first sheet into second sheets and margins, the machine comprising:

a first conveying part arranged to convey the first sheet along a conveying path;

a cutting part arranged downstream of and apart from the first conveying part to cut the first sheet in a direction perpendicular to a conveying direction;

a sorting unit arranged to remove the margins from the conveying path, the margins being cut off from the first sheet by the cutting part; and a control unit configured to control the first conveying part, the cutting part and the sorting unit based on cutting information about cutting of the first sheet.

The sorting unit includes:

a second conveying part arranged downstream of and apart from the cutting part to receive the first sheet from the first conveying part and to convey the second sheets cut off from the first sheet by the cutting part; and a retracting mechanism arranged to upwardly retract the second conveying part from the conveying path.

When a length in the conveying direction of the margin to be cut off is shorter than a predetermined distance between the cutting part and the second conveying part, the first sheet is fed to the cutting part by the first conveying part while the second conveying part is kept positioned at the conveying path, and the margin is cut off from the first sheet by the cutting part. When the length is equal to or longer than the predetermined distance, the first sheet is fed to the cutting part by the first conveying part after the second conveying part is retracted from the conveying path by the retracting mechanism, and the margin is cut off from the first sheet by the cutting part.

The sorting unit may further include a deflecting plate for deflecting the first sheet to the outside of the conveying path while the first sheet is conveyed by the first conveying part. The deflecting plate may be moved together with the second conveying part by the retracting mechanism. It is preferable that the deflecting plate is apart from the conveying path when the second conveying part stays at the conveying path, and that the deflecting plate stays at the conveying path when the second conveying part is apart from the conveying path.

The sheet cutting machine may further comprise a frame having the conveying path. The sorting unit may further include a pair of support plates arranged in a vertically swingable manner relative to the frame about a horizontal axis perpendicular to the conveying direction. The pair of the support plates may be opposite to each other in a direction perpendicular to the conveying direction so as to support the second conveying part. The retracting mechanism may retract the second conveying part from the conveying path by upwardly swinging the support plates.

The second conveying part may include a pair of conveying rollers rotatably supported by the support plates and extending perpendicularly to the conveying direction and horizontally.

The sorting unit may further include:

a third conveying part arranged downstream of and apart from the second conveying part to receive the second sheets from the second conveying part and to convey the second sheets; and a guide plate attached to the support plates and arranged between the second conveying part and the third conveying part to guide the second sheets from the second conveying part to the third conveying part.

The cutting part may include a pair of cutting blades vertically opposite to each other with the conveying path interposed therebetween.

Effect of the Invention

In the sheet cutting machine according to the present invention, when the length in the conveying direction of the margin to be cut off is equal to or longer than the predetermined distance between the cutting part and the second conveying part, the retracting mechanism upwardly retracts the second conveying part from the conveying path, and then the first conveying part feeds the first sheet to the cutting part. Therefore, the first sheet is prevented from coming into contact with the second conveying part when being fed to the cutting part. The margin which has been cut off is removed from the conveying path by falling down without coming into contact with the second conveying part.

Thus, the margin is separated from the first sheet in only one cutting operation and reliably removed from the conveying path, even when the margin has any length in the conveying direction. The efficiency of the sheet cutting machine can be improved because the several cutting operations are not required for the separation of the margin.

MODE FOR CARRYING OUT THE INVENTION

A sheet cutting machine according to an embodiment of the present invention will be described below with reference to the accompanying drawings.

Figure 1:
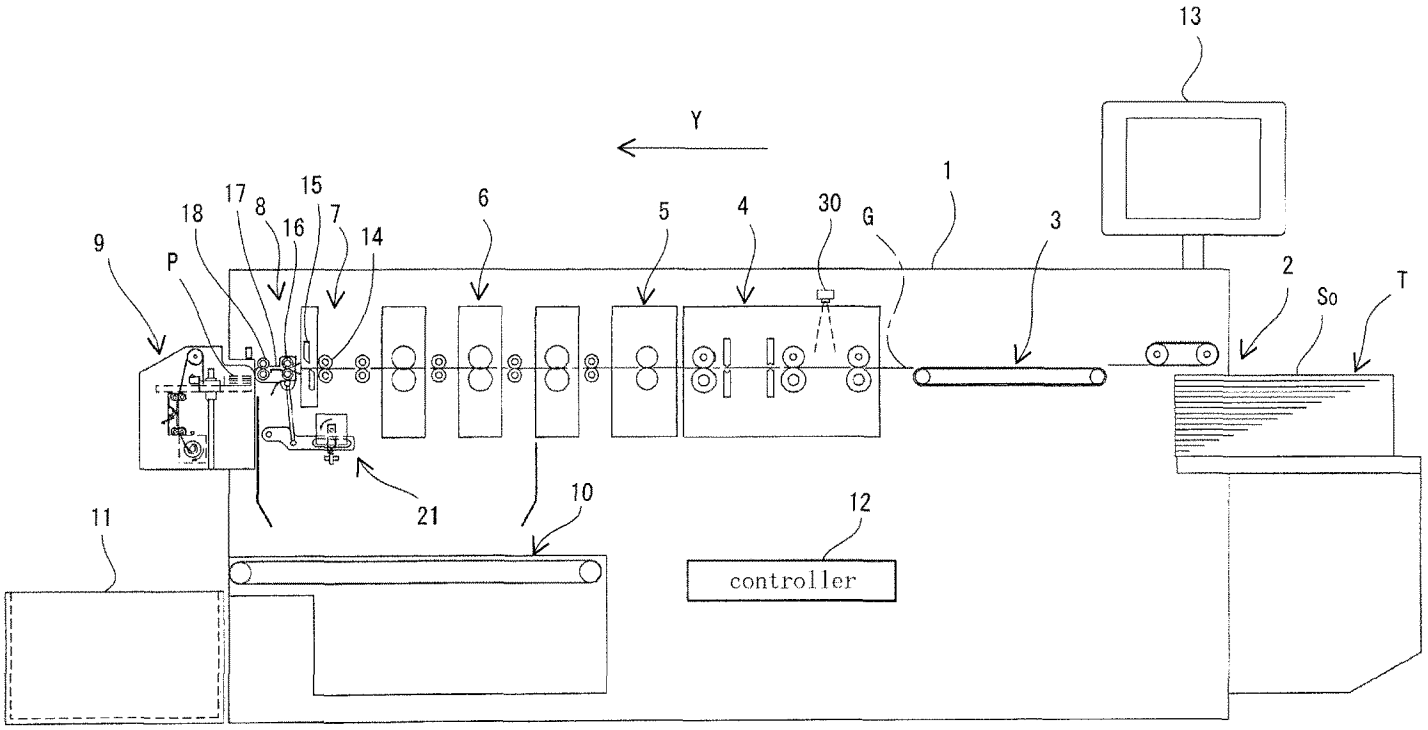
FIG. 1 is a schematic front sectional view of a sheet cutting machine according to one embodiment of the present invention.
Figure 2:
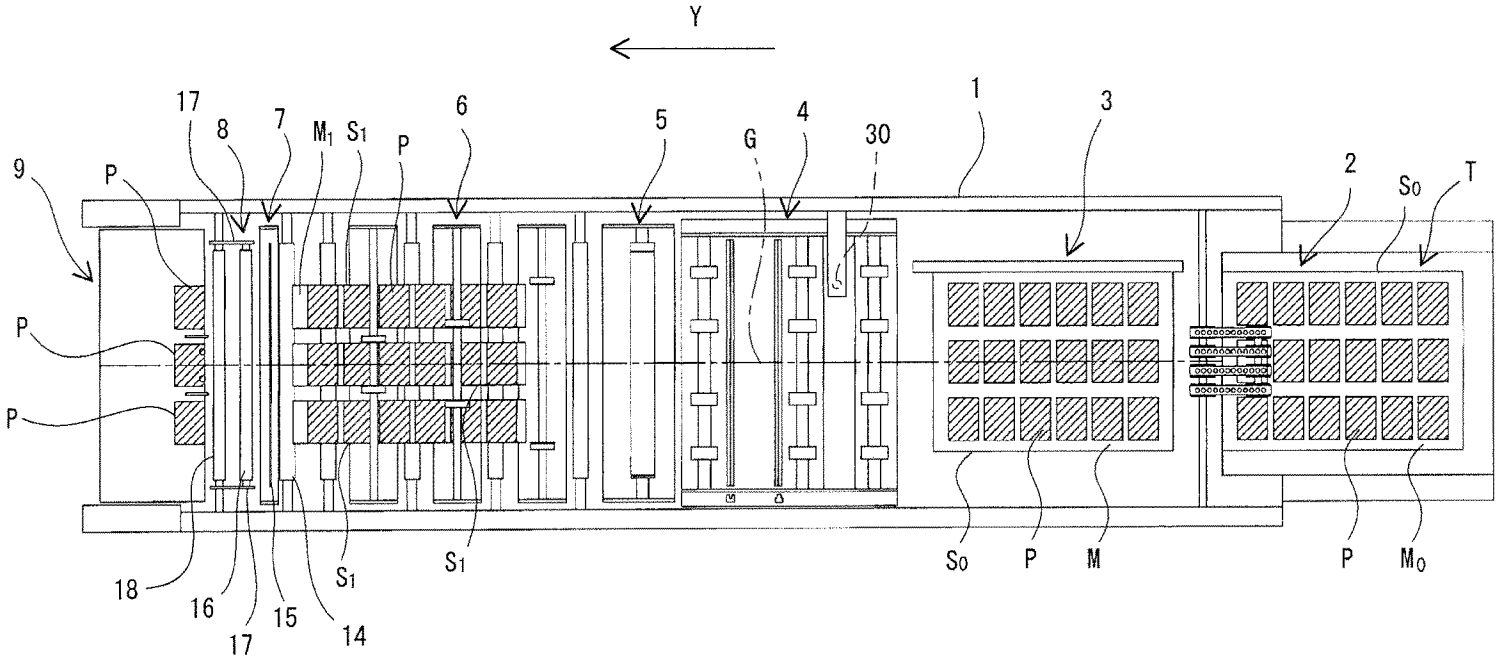
FIG. 2 is a schematic horizontal sectional view of the sheet cutting machine of FIG. 1.

With reference to FIGS. 1 and 2, a sheet cutting machine comprises a frame 1 having a conveying path G, and a feeding unit 2 arranged to feed sheets $S_0$ one by one from a sheet stack T which consists of a plurality of the sheets $S_0$ stacked with each other. As shown in FIG. 2, in this embodiment, each of the sheets $S_0$ consists of products P arranged in a matrix manner, and a margin $M_0$ surrounding the products P.

A sheet conveying unit 3 is arranged downstream of the sheet feeding unit 2 to convey along the conveying path G the sheet $S_0$ fed from the sheet feeding unit 2 while correcting a skew of the sheet $S_0$. A creasing unit 4 is arranged downstream of the sheet conveying unit 3 to receive the sheet $S_0$ from the sheet conveying unit 3 and to crease the sheet $S_0$. A perforating unit 5 is arranged downstream of the creasing unit 4 to receive the sheet $S_0$ from the creasing unit 4 to perforate the sheet $S_0$.

Figure 3:
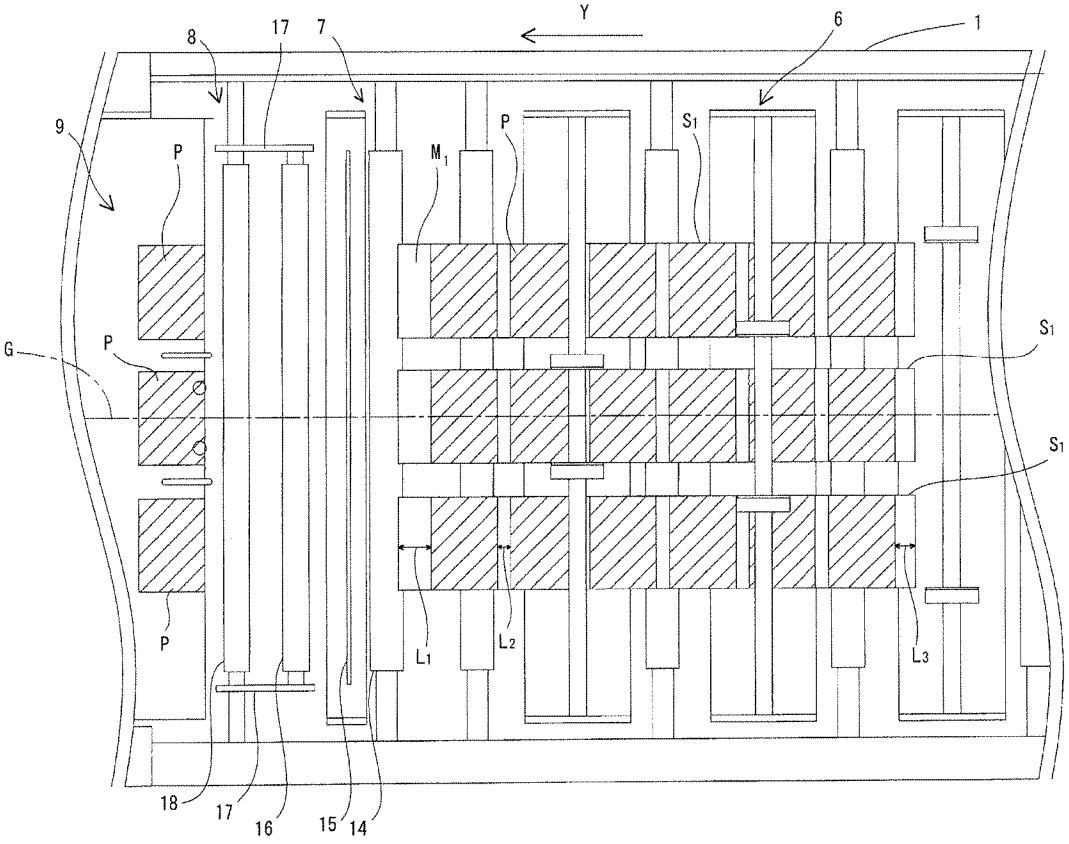
FIG. 3 is an enlarged horizontal sectional view of a cutting unit and a sorting unit of the sheet cutting machine of FIG. 2.

As shown in FIGS. 1 to 3, a slitting unit 6 is arranged downstream of the perforating unit 5. The slitting unit 6 receives the sheet $S_0$ from the perforating unit 5, and cuts the sheet $S_0$ in the conveying direction Y while conveying the sheet $S_0$ along the conveying path G, and thereby forms sub-sheets $S_1$. Each of sub-sheets S1 consists of the products P and margins $M_1$ alternately arranged in the conveying direction Y as shown in FIGS. 2 and 3. Margins (not shown) extending in the conveying direction Y are also formed together with the sub-sheets $S_1$ by cutting of the sheet $S_0$. The slitter unit 6 removes these margins from the conveying path G, so that only the sub-sheets $S_1$ are fed downstream.

A cutting unit 7 is arranged downstream of the slitter unit 6. The cutting unit 7 receives the sub-sheets $S_0$ from the slitter unit 6 and cuts each of the sub-sheets S (corresponding to a first sheet defined in the claims) into the products P (corresponding to second sheets defined in the claims) and margins $M_1$. Further, a sorting unit 8 is arranged to remove from the conveying path G the margins $M_2$ cut off.

A stacking unit 9 is arranged downstream of the sorting unit 8 to receive the products P from the sorting unit 8 and to stack the products P.

As shown in FIG. 1, a margin conveying unit 10 is arranged under the slitter unit 6, the cutting unit 7, and the sorting unit 8, to convey to a receiving box 11 the margins $M_1$ which have been removed from the conveying path G and fallen down.

As shown in FIG. 1, the sheet cutting machine further comprises a control unit (controller) 12 configured to control the sheet feeding unit 2, the sheet conveying unit 3, the creasing unit 4, the perforating unit 5, the slitting unit 6, the cutting unit 7, the sorting unit 8, the stacking unit 9 and the margin conveying unit 10. Further, an input part 13 is arranged to be used for inputting the cutting information about cutting of each sheet $S_0$. The input part 13 includes a touch panel display.

Figure 4A:
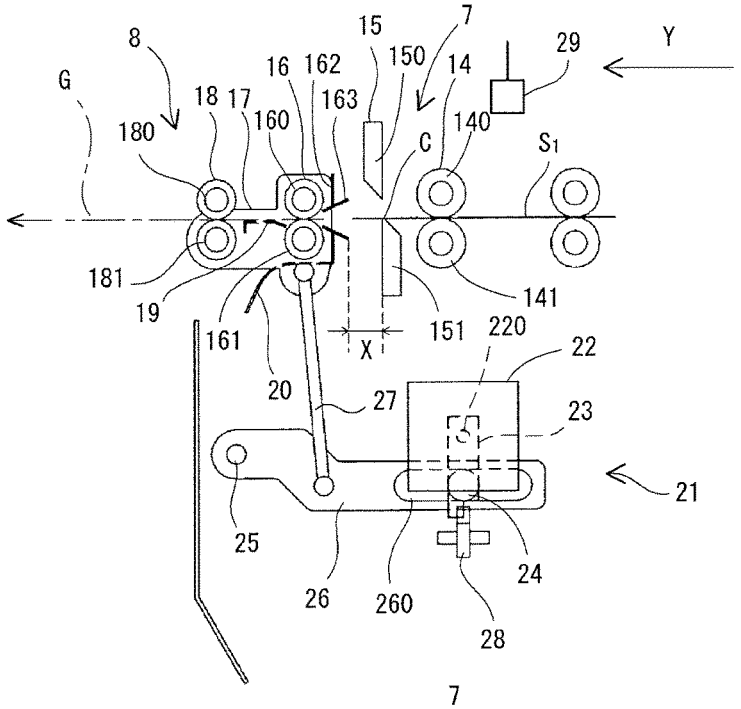
FIGS. 4A and 4B illustrate that a margin is cut off from a sheet without a retraction of a second conveying part from a conveying path.

As shown in FIGS. 3 and 4A, the cutting unit 7 includes the first conveying part 14 arranged to receive the sub-sheets $S_1$ from the slitting unit 6 and to convey the sub-sheets $S_1$ along the conveying path G, and a cutting part 15 arranged downstream of and apart from the first conveying part 14 to cut the sub-sheets $S_1$ in a direction perpendicular to the conveying direction Y.

Referring to FIG. 4A, the first conveying part 14 includes a pair of first conveying rollers 140 and 141. Each of the conveying rollers 140 and 141 is supported by the frame 1 rotatably about a shaft thereof and extends perpendicularly to the conveying direction Y and horizontally. A first roller drive mechanism (not shown) is arranged to drive the pair of the first conveying rollers 140 and 141.

The cutting part 15 includes a pair of cutting blades 150 and 151 vertically opposite to each other with the conveying path G interposed therebetween, and extending perpendicularly to the conveying direction Y and horizontally. A blade drive mechanism (not shown) is arranged to vertically move the upper blade 150 relative to the lower blade 151.

Referring to FIG. 4A, the sorting unit 8 includes a second conveying part 16 arranged downstream of and apart from the cutting part 15 to receive the sub-sheet $S_1$ being conveyed by the first conveying part 14 and to covey the products P cut off from the sub-sheet $S_1$ by the cutting part 15. A pair of support plates 17 (see FIG. 3) is arranged opposite to each other in a horizontal direction perpendicular to the conveying direction Y so as to support the second conveying part 16.

The second conveying part 16 includes a pair of second conveying rollers 160 and 161. Each of the conveying rollers 160 and 161 is supported by the support plates 17 rotatably about a shaft thereof and extends perpendicularly to the conveying direction Y and horizontally. The pair of the second conveying rollers 160 and 161 is driven by a second roller drive mechanism (not shown). The second conveying part 16 further includes a front plate 162 attached to the support plates 17 and arranged upstream of the pair of the second conveying rollers 160 and 161, and an inlet port 163 formed in the front plate 162. The sub-sheet $S_1$ is conveyed by the first conveying part 14 along the conveying path G through the inlet port 163, and then received by the pair of the second conveying rollers 160 and 161.

The sorting unit 8 further includes a third conveying part 18 arranged downstream of and apart from the second conveying part 16 to receive the products P from the second conveying part 16 and to convey the products P to the stacking unit 9. The third conveying part 18 includes a pair of the third conveying rollers 180 and 181 extending perpendicularly to the conveying direction Y and horizontally, and driven by a third roller drive mechanism (not shown). The upper roller 180 is attached to the support plates 17 rotatably about a shaft thereof. The lower roller 181 penetrates the support plates 17 and is attached to the frame 1 rotatably about a shaft thereof.

A guide plate 19 is attached to the support plates 17 and is arranged between the second conveying part 16 and the third conveying part 18 to guide the products P from the second conveying part 16 to the third conveying part 18.

The pair of the support plates 17 is supported by the shaft of the lower roller 181 in a vertically swingable manner about the shaft. Thereby, the pair of the support plates 17 is arranged in a vertically swingable manner relative to the frame 1 about a horizontal axis perpendicular to the conveying direction Y.

Further, the sorting unit 8 includes a deviating plate 20 attached to the pair of the support plates 17, arranged below the second conveying part 16, and extending perpendicular to the conveying direction Y and horizontally. The deviating plate 20 has an arc-shaped cross section. The deviating plate 20 is arranged for deviating the sub-sheet $S_1$ to the outside of the conveying path G while the sub-sheet $S_1$ is conveyed by the first conveying part 14, as described in detail below.

The soring unit 8 further includes the retracting mechanism 21 arranged to upwardly retract the second conveying part 16 form the conveying path G.

A motor 22 is mounted on the frame 1 and is arranged below the conveying path G. An output shaft 220 of the motor extends perpendicularly to the conveying direction Y and horizontally. A first arm 23 is attached to the output shaft 220 at one end thereof. A roller 24 is rotatably attached to the other end of the first arm 23.

A support shaft 25 is attached to the frame 1 and extends perpendicularly to the conveying direction Y and horizontally. A second arm 26 is supported by the support shaft 25 at one end thereof in a vertically swingable manner about the support shaft 25. A slot 260 extending in the longitudinal direction of the second arm 26 is formed in the other side of the second arm 26. The roller 24 of the first arm 23 is inserted in the slot 260 in such a manner that the roller 24 can roll along the slot 260.

A third arm 27 is attached to the second arm 26 at one end thereof and is attached to the support plate 17 at the other end thereof.

Figure 4B:
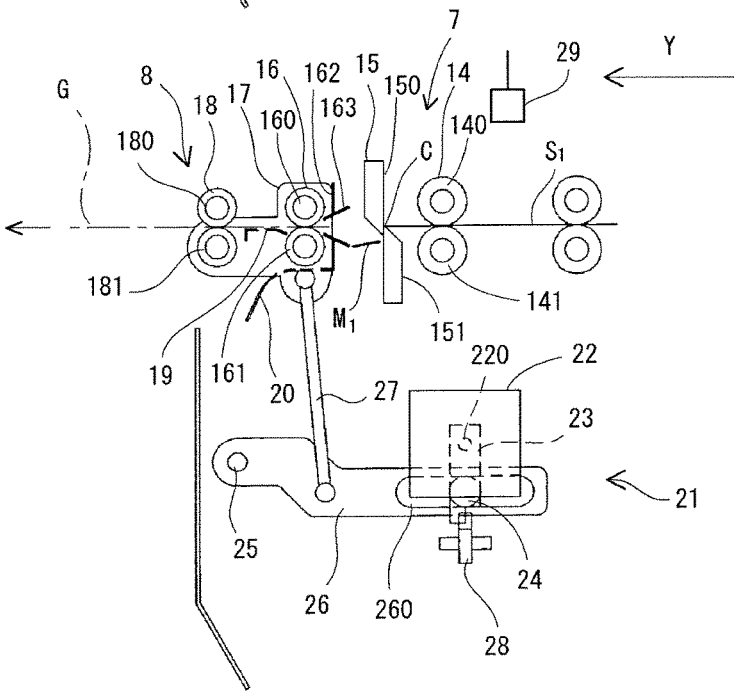
Figure 5A:
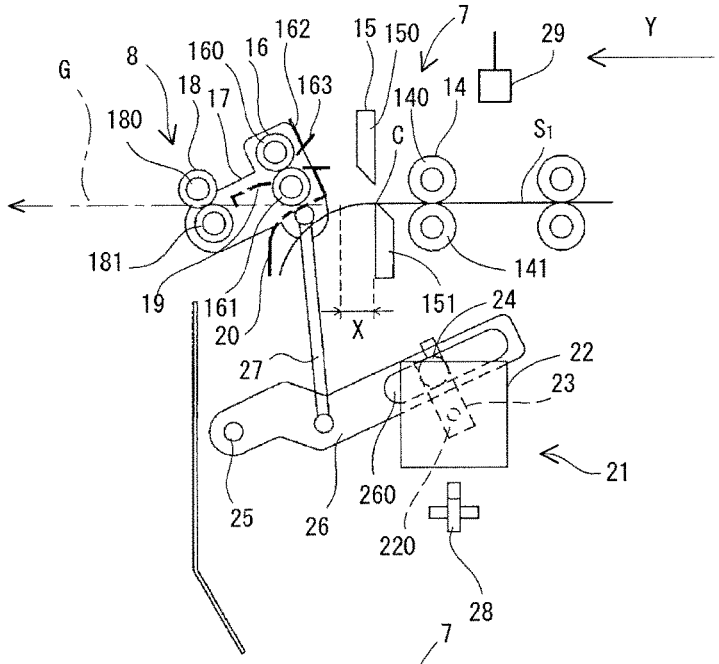
FIGS. 5A and 5B illustrate that a margin is cut off from a sheet after a retraction of a second conveying part from a conveying path.
Figure 5B:
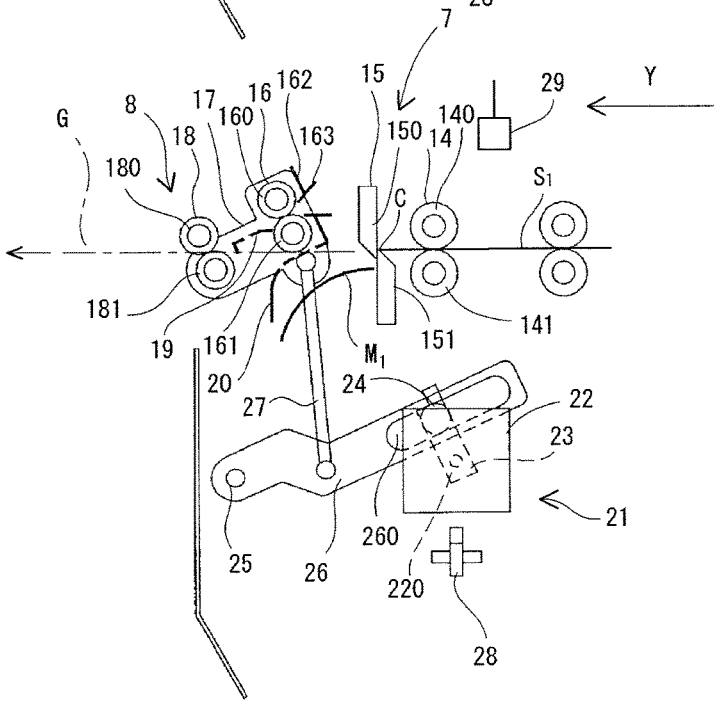

When the first arm 23 is rotated by driving of the motor 22, the second and the third arms 26 and 27 vertically swing, and thereby the support plates 17 vertically swing about the lower roller 181 as shown in FIGS. 4 and 5. As a result, the second conveying part 16 is reciprocated between a first position (FIG. 4A) where the second conveying part 16 stays at the conveying path G and a second position (FIG. 5A) where the second conveying part 16 is apart upwardly from the conveying path G.

Because the deviating plate 20 is attached to the support plates 17, the deviating plate 20 is moved together with the second conveying part 16 by the retracting mechanism 21. As shown in FIG. 4A, the deviating plate 20 is apart downwardly from the conveying path G when the second conveying part 16 stays at the conveying path G. As shown in FIG. 5A, the deviating plate 20 stays at the conveying path G when the second conveying part 16 is apart upwardly from the conveying path G.

A position sensor 28 is arranged to detect that the second conveying part 16 stays at the conveying path G.

The retracting mechanism 21 is structured as described above.

As described in detail below, the control unit 12 controls the first to third conveying parts 14, 16 and 18, the cutting part 15 and the retracting mechanism 21 based on the cutting information about cutting of the sub-sheet $S_1$ obtained in advance in such a manner that the sub-sheet $S_1$ is divided into the products P and the margins $M_1$, and the margins $M_1$ are removed from the conveying path G, and that only the products P are conveyed to the stacking unit 9.

The cutting information includes information about the cutting locations on the sub-sheet $S_1$, information about the lengths in the conveying direction of the margins $M_1$ and the products P to be cut off from the sub-sheet $S_1$, and so on. An operator can input the cutting information through the input part 13. The control unit 12 receives the cutting information from the input part 13. Alternately, the control unit 12 may receive the cutting information from the processing machine such as a printer for printing on the sheet $S_0$ arranged upstream of the sheet cutting machine. The control unit 12 may obtain the cutting information by imaging a mark (not shown) such as a barcode provided on the margin $M_0$ of the sheet $S_0$ with a camera 30 (see FIGS. 1 and 2).

As shown in FIG. 4, a sheet sensor 29 is arranged upstream of the first conveying part 14 to detect a passage of the sub-sheet $S_1$. A detect signal of the sheet sensor 20 is sent to the control unit 12. The control unit 12 operates the first to third conveying parts 14, 16 and 18, the cutting part 15 and the retracting mechanism 21 at a timing determined based on the detection signal of the sheet sensor 29.

The control unit 12 stores in advance the predetermined distance X between the cutting part 15 and the second conveying part 16. In this embodiment, the predetermined distance X is defined as a distance between a cutting position C on the conveying path G where the cutting blades 150 and 151 cut sub-sheet $S_1$, and the upstream end of the inlet port 163 in the second conveying part 16 positioned at the conveying path G.

The cutting operation of the sub-sheet $S_1$ will be described below.

As shown in FIG. 3, a front end of the sub-sheet $S_1$ conveyed from the slitter unit 6 is formed of the margin $M_1$ having a length $L_1$ in the conveying direction. First, this margin $M_1$ is cut off from the sub-sheet $S_1$.

The control unit 12 compares the length $L_1$ with the distance X.

When the length $L_1$ is smaller than the distance X ($L_1$<X), as shown in FIG. 4A, the sub-sheet $S_1$ is fed to the cutting part 15 by the first conveying part 14, and travelled between the pair of the cutting blades 150 and 151 by the length $L_1$ from the cutting position C, while the second conveying part 16 is kept positioned at the conveying path G. As shown in FIG. 4B, the margin $M_1$ is then cut off from the sub-sheet $S_1$ by the cutting part 15. This is achieved by cutting the sub-sheet $S_1$ along a border between the margin $M_1$ and the product P by means of downward movement of the upper blade 150.

The conveyance of the sub-sheet $S_1$ is temporarily paused during cutting of the sub-sheet $S_1$. The same is applied hereinafter.

The margin $M_1$ cut off falls down from a gap between the cutting part 15 and the second conveying part 16, and consequently is removed from the conveying path G.

When the length $L_1$ is equal to or longer than the distance $X_1$ ($L_1$>=X), as shown in FIG. 5, the retracting mechanism 21 upwardly retracts the second conveying part 16 from the conveying path G and positions the deviate plate 20 at the conveying path G. After that, the sub-sheet $S_1$ is fed to the cutting part 15 by the first part 14, and travelled between the pair of the cutting blades 150 and 151 by the length $L_1$ from the cutting position C. At this time, the front of the sub-sheet $S_1$ is downwardly deviated from the conveying path G by the deviating plate 20. The margin $M_1$ is then cut off from the sub-sheet S by the cutting part 15 and falls down. After the margin $M_1$ is cut off, the retracting mechanism 21 moves the second conveying part 16 back to the conveying path G and retracts the deviating plate 20 from the conveying path G.

The front end of the sub-sheet $S_1$ is formed of the product P, because the margin $M_1$ having the length $L_1$ in the conveying direction has been cut off. Subsequently, this product P is cut off from the sub-sheet $S_1$.

Figure 6A:
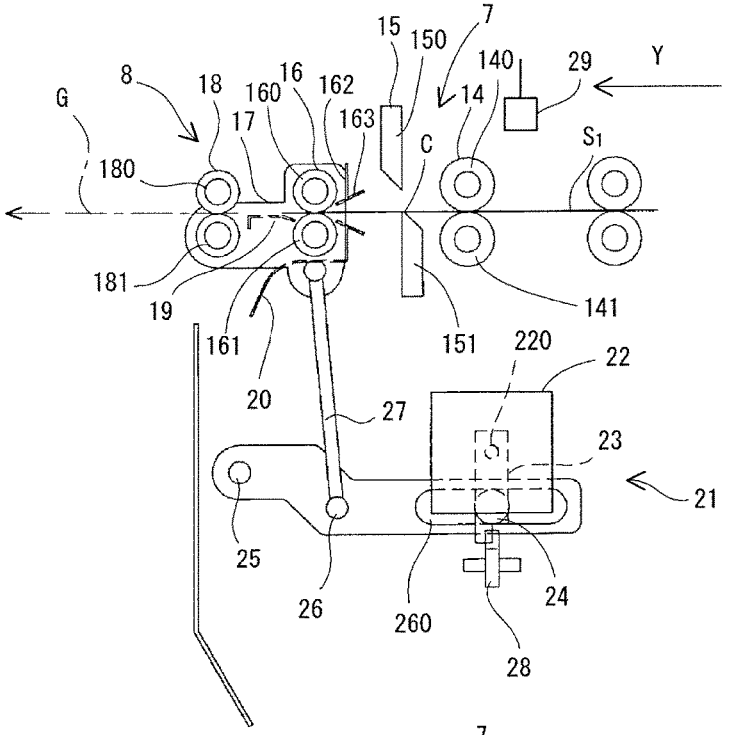
FIGS. 6A and 6B illustrate that a product is cut off from the sheet.
Figure 6B:
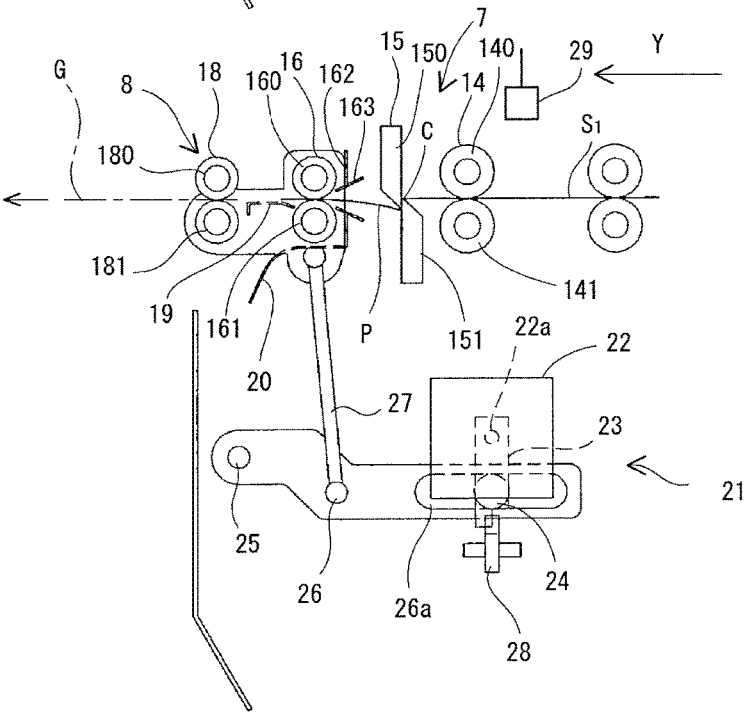

As shown in FIG. 6, the sub-sheet $S_1$ is fed to the cutting part 15 by the first conveying part 14, and travelled between the cutting blades 150 and 151 by the length in the conveying direction of the product P from the cutting position C. At this time, the front of the sub-sheet $S_1$ is received by the pair of the conveying rollers 160 and 161 of the second conveying part 16. As shown in FIG. 6B, the product P is then cut off from the sub-sheet $S_1$.

After the product P is cut off, the front end of the sub-sheet $S_1$ is formed of the margin $M_1$ having the length $L_2$ in conveying direction. Subsequently, this margin $M_1$ is cut off from sub-sheet $S_1$.

The control unit 12 compares the length $L_2$ in the conveying direction of the margin $M_1$ with the distance X.

When the length $L_2$ is smaller than the distance X ($L_2$<X), the sub-sheet $S_1$ is fed to the cutting part 15 by the first conveying part 14, and travelled between the cutting blades 150 and 151 by the length $L_2$ from the cutting position C, while the second conveying part 16 is kept positioned at the conveying path G. The margin $M_1$ is then cut off from the sub-sheet $S_1$ by the cutting part 15 and falls down. At the same time, the product P which has been cut off previously is conveyed along the conveying path G to the stacking unit 9 by the second and third conveying parts 16 and 18, and then stacked.

Figure 7A:
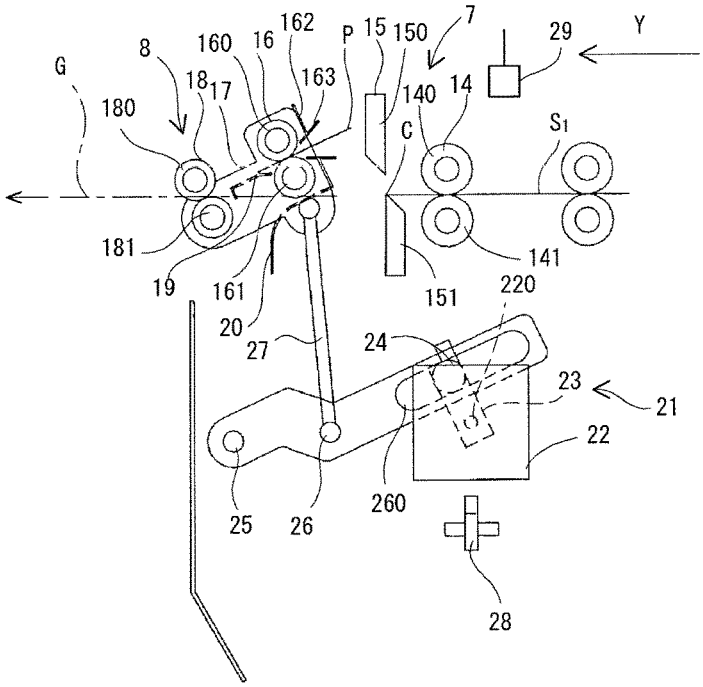
FIGS. 7A and 7B illustrate that a margin is cut off from a sheet after a retraction of a second conveying part from a conveying path.
Figure 7B:
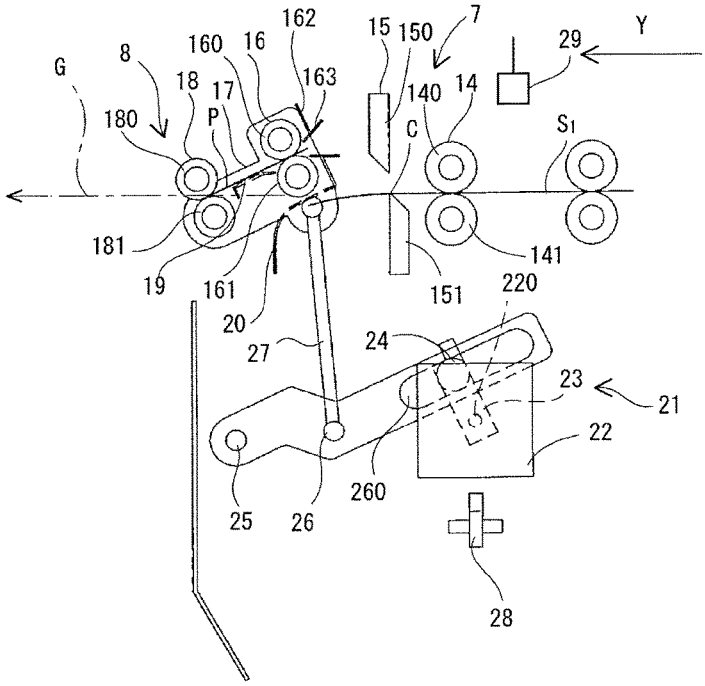
Figure 8:
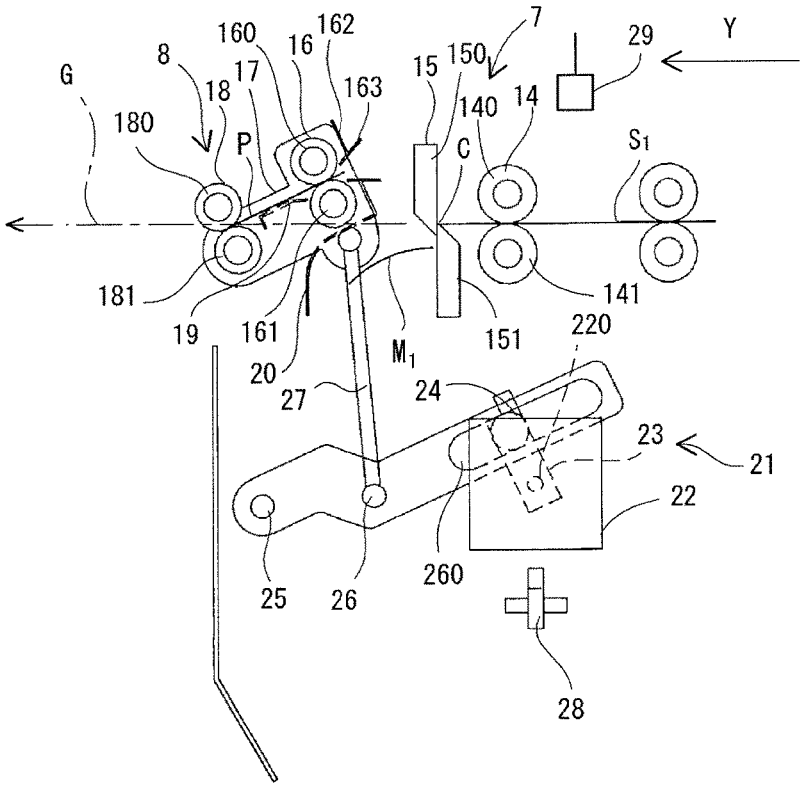
FIG. 8 illustrates that a margin is cut off from a sheet after a retraction of a second conveying part from a conveying path.

When the length $L_2$ is equal to or longer than the distance X ($L_2$>=X), as shown in FIGS. 7A and 7B the sub-sheet $S_1$ is fed to the cutting part 15 by the first conveying part 14 and travelled between the cutting blades 150 and 151 by the length $L_2$ from the cutting position C, after the second conveying part 16 is retracted from the conveying path G by the retracting mechanism 21. As shown in FIG. 8, the margin $M_1$ is then cut off from the sub-sheet $S_1$ and falls down. After the margin $M_1$ is cut off, the retracting mechanism 21 moves the second conveying part 16 back to the conveying path G and retracts the deviating plate 20 from the conveying path G At the same time, as shown in FIGS. 7A, 7B and 8, while the second conveying part 16 is kept retracted from the conveying path G, the product P which has been cut off previously is conveyed by the second conveying rollers 160 and 161. The product P is guided to the third conveying part 18 by the guide plate 19. The third conveying part 18 receives the product P form the second conveying part 16 using the conveying rollers 180 and 181, and conveys the product P to the stacking unit 9.

Thereafter, the products P and the margins $M_1$ are alternately cut off from the sub-sheet S in the same way.

A last margin $M_1$ formed of the back end of the sub-sheet $S_1$ and having a length $L_3$ in the conveying direction is removed from the conveying path G in the different way.

In brief, when the length $L_3$ is short, the last margin $M_1$ is not held by the first conveying part 14 during cutting of the last product P. As a result, the last margin $M_1$ falls down from a gap between the first conveying part 14 and the cutting part 15. When the length $L_3$ is so long that the last margin $M_1$ is held by the first conveying part 14, the margin $M_1$ is fed by the first conveying part 14 and then divided into two margins by the cutting part 15. One of the divided margins falls down from the gap the between the first conveying part 14 and the cutting part 15. The other of the divided margins falls down from a gap between the cutting part 15 and the second conveying part 16. The second conveying part 16 is kept retracted from the conveying path G by the retracting mechanism 21 if necessary while the last margin $M_1$ is fed by the first conveying part 14.

Such cutting of the sub-sheet $S_1$ is performed for the sub-sheets $S_1$ which are conveyed one by one to the cutting unit 7.

As described above, the length $L_1$ or $L_2$ in conveying direction of the margin $M_1$ to be cut off is equal to or longer than the predetermined distance X, the sub-sheet $S_1$ is fed to the cutting part 15 by the first conveying part 14, after the second conveying part 16 is retracted from the conveying path G by the retracting mechanism 21. Therefore, the sub-sheet $S_1$ is prevented from coming into contact with the second conveying part 16 and from being received by second conveying part 16, while being fed to the cutting part 15 for cutting off of the margin $M_1$.

Consequently, the margin $M_1$ is separated from the sub-sheet $S_1$ in only one cutting operation and reliably removed from the conveying path G even when the margin $M_1$ has a length in the conveying direction longer than the distance X. Further, the efficiency of the sheet cutting machine can be improved because several cutting operations are not required for the separation of the margin $M_1$.

Although the embodiment of the present invention has been described above, the present invention is not restricted to the above embodiment.

In the above embodiment, the second conveying part 16 includes the front part 162 and the inlet port 163. In alternative embodiment, the second conveying part 16 may not include these. The retracting mechanism 21 may vertically and linearly move the second conveying part 16 instead of vertically swinging it.

The slitter unit 6 may be arranged between the sorting unit 8 and the stacking unit 9 instead of being arranged upstream of the cutting unit 7.

Figure 9:
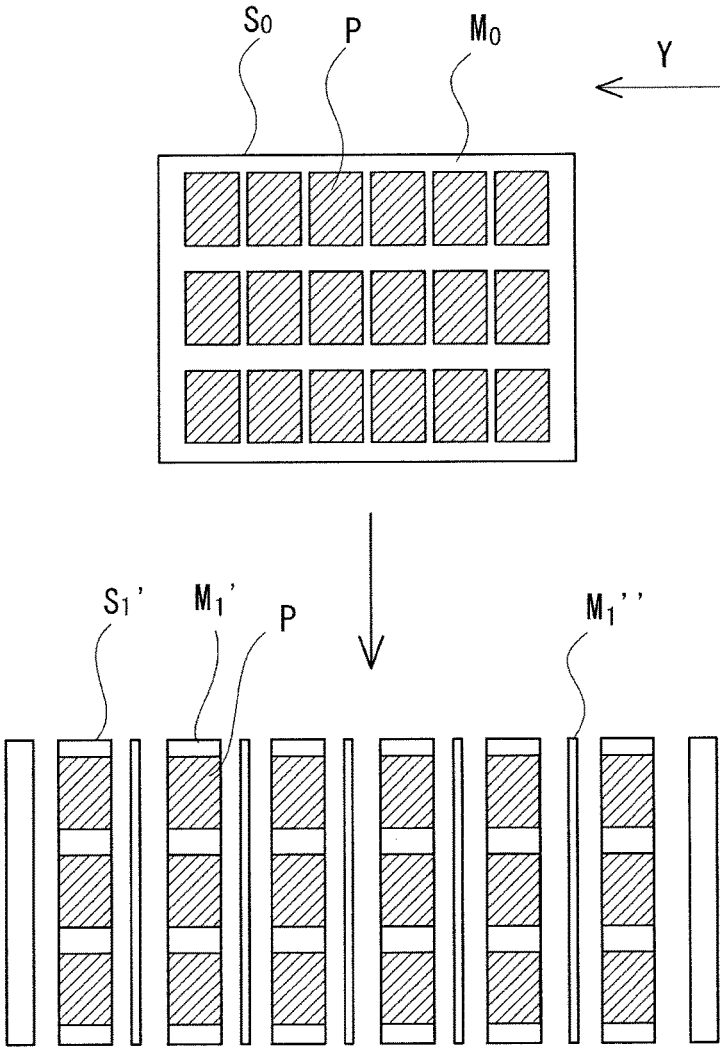
FIG. 9 illustrates cutting of a sheet according to another embodiment of the present invention.

In this case, referring to FIG. 9, the cutting unit 7 cuts the sheet $S_0$ (corresponding to a first sheet defined in the claims) in a direction perpendicular in the conveying direction Y into sub-sheets $S_1'$ (corresponding to second sheets defined in the claims) and margins $M_1''$. Each of the sub-sheets $S_1'$ consists of margins $M_1'$ and products P alternately arranged in conveying direction Y. Each of the margin $M_1''$ extends in a direction perpendicular to the conveying direction Y. The sorting unit 8 operates in the same way as the above embodiment, so that the margins $M_1''$ are removed from the conveying path G, and that only the sub-sheets $S_1'$ are fed to the slitter unit 6. The slitter unit 6 cuts the sub-sheet $S_1'$ in the conveying direction Y into the products P and the margins $M_1'$, removes the margins $M_1'$ from the conveying path G, and feeds only the products P to the staking unit 9.

EXPLANATION OF REFERENCES

1 frame
7 cutting unit
8 sorting unit
12 control unit
14 first conveying part
140, 141 pair of conveying rollers
15 cutting part
150 upper blade
151 lower blade
16 second conveying part
160, 161 pair of conveying rollers
17 support plate
18 third conveying plate
180,181 pair of conveying rollers
19 guide plate
20 deviating plate
C cutting position
G conveying path
$M_0$, $M_1$ margin
$S_0$ sheet
$S_1$ sub-sheet
P product
X predetermined distance
Y conveying direction
$L_1$, $L_2$ length in a conveying direction of a margin

The invention claimed is:

1. A sheet cutting machine for cutting a first sheet into second sheets and margins, the machine comprising:

a first conveying part arranged to convey the first sheet along a conveying path;

a cutting part arranged downstream of and apart from the first conveying part to cut the first sheet in a direction perpendicular to a conveying direction;

a sorting unit arranged to remove the margins from the conveying path, the margins being cut off from the first sheet by the cutting part; and a control unit configured to control the first conveying part, the cutting part and the sorting unit based on. cutting information about cutting of the first sheet, the sorting unit including:

a second conveying part arranged downstream of and apart from the cutting part to receive the first sheet from the first conveying part and to convey the second sheets cut off from the first sheet by the cutting part;

a retracting mechanism arranged to upwardly retract the second conveying part from the conveying path; and a deflecting plate for deflecting the first sheet away from the conveying path while the first sheet is conveyed by the first conveying part, the deflecting plate being moved together with the second conveying part by the retracting mechanism, wherein when a first length in the conveying, direction of the margin to be cut off is shorter than a predetermined distance between the cutting part and the second conveying part, the first sheet is fed to the cutting part by the first conveying part while the second conveying part is kept positioned at the conveying path, and the margin is cut off from the first sheet by the cutting part, and when a second length is equal to or longer than. the predetermined distance, the first sheet is fed to the cutting part by the first conveying, part after the second conveying part is retracted from the conveying path by the retracting mechanism, and the margin is cut off from the first sheet by the cutting part, and wherein the deflecting plate is apart from the conveying path when the second conveying part stays at the conveying path, and the deflecting plate stays at the conveying path when the second conveying part is apart from the conveying path.

2. The sheet cutting machine according to claim 1, further comprising a frame, wherein the sorting unit further includes a pair of support plates arranged in a vertically swingable manner relative to the frame about a horizontal axis perpendicular to the conveying direction, the pair of the support plates being opposite to each other in a direction perpendicular to the conveying direction so as to support the second conveying part, the second conveying part includes a pair of conveying rollers rotatably supported by the support plates and extending perpendicularly to the conveying direction and horizontally, and the retracting mechanism retracts the second conveying part from the conveying path by upwardly swinging the support plates.

3. The sheet cutting machine according to claim 2, wherein the sorting unit further includes a third conveying part arranged downstream of and apart from the second conveying part to receive the second sheets from the second conveying part and to convey the second sheets, the third conveying part including a pair of conveying rollers extending perpendicularly to the conveying direction and horizontally, and wherein, an upper roller of the conveying rollers of the third conveying part is attached to the support plates rotatably about a shaft thereof, and a lower roller of the conveying rollers of the third conveying part is attached to the frame rotatably about a shaft thereof.

4. The sheet cutting machine according to claim 3, wherein the sorting unit further includes a guide plate attached to the support plates and arranged between the second conveying part and the third conveying part to guide the second sheets from the second conveying part to the third conveying part.

5. The sheet cutting machine according to claim 1, wherein the cutting part includes a pair of cutting blades vertically opposite to each other with the conveying path interposed therebetween.

* * * * *